US005551868A

United States Patent [19]

Smoker et al.

[11] Patent Number: 5,551,868

[45] Date of Patent: Sep. 3, 1996

[54] PREHEATER BLOCK FOR MULTI OIL FURNACES

[75] Inventors: Benjamin K. Smoker; David J. Yoder; Benuel F. Smoker; Frederick W. Phillips, all of Leola, Pa.

[73] Assignee: Clean Burn, Inc., Leola, Pa.

[21] Appl. No.: 227,257

[22] Filed: Apr. 14, 1994

[51] Int. Cl.[6] ..... F23D 11/44

[52] U.S. Cl. ..... 431/208; 431/11

[58] Field of Search ..... 431/208, 11, 207

[56] References Cited

U.S. PATENT DOCUMENTS

| | | | |
|---|---|---|---|
| 1,493,820 | 5/1924 | Miller | 431/207 |
| 2,841,215 | 7/1958 | Messer | 431/28 |
| 3,070,151 | 12/1962 | Goossens | 431/28 |
| 3,291,191 | 12/1966 | Stoops | 431/11 |
| 3,477,644 | 11/1969 | Bablouzian et al. | 431/208 X |
| 3,977,823 | 8/1976 | Bernhard | 431/11 |
| 4,047,880 | 9/1977 | Caldarelli | 431/208 |
| 4,162,887 | 7/1979 | Gray | 431/28 |
| 4,392,820 | 7/1983 | Niederholtmeyer | 431/11 X |
| 4,460,328 | 7/1984 | Niederholtmeyer | 431/11 |
| 4,877,395 | 10/1989 | Schubach | 431/28 |
| 5,067,894 | 11/1991 | Bender | 431/208 |
| 5,149,260 | 9/1992 | Foust | 431/11 |

FOREIGN PATENT DOCUMENTS

| | | | |
|---|---|---|---|
| 0221610 | 11/1985 | Japan | 431/208 |
| 479019 | 1/1938 | United Kingdom | 431/208 |
| 2091870 | 8/1982 | United Kingdom | 431/208 |

OTHER PUBLICATIONS

Jun., 1990, Reznor sales brochure for "Waste Oil Heater".

Aug. 25, 1992, Clean Burn Operator's Manual for Models CB–90–AH and CB–90–BH with CB–90–HS Burner.

*Primary Examiner*—Carl D. Price

[57] ABSTRACT

A preheater block for a multi oil furnace is disclosed wherein the metallic preheater block is formed with a separate heater chamber housing a heating element to provide conductive heat throughout the preheater block which is provided with a first flow path defining multiple passes through the preheater block to raise the temperature of the flow of used oil therethrough to a predetermined level. An oil flow regulator is coupled to the first flow path to permit a manual regulation of the rate of oil flow through the preheater block after the used oil has attained the predetermined temperature. A second flow path is defined within the preheater block to allow a flow of compressed air therethrough to reach substantially the same predetermined temperature as the used oil.

19 Claims, 8 Drawing Sheets

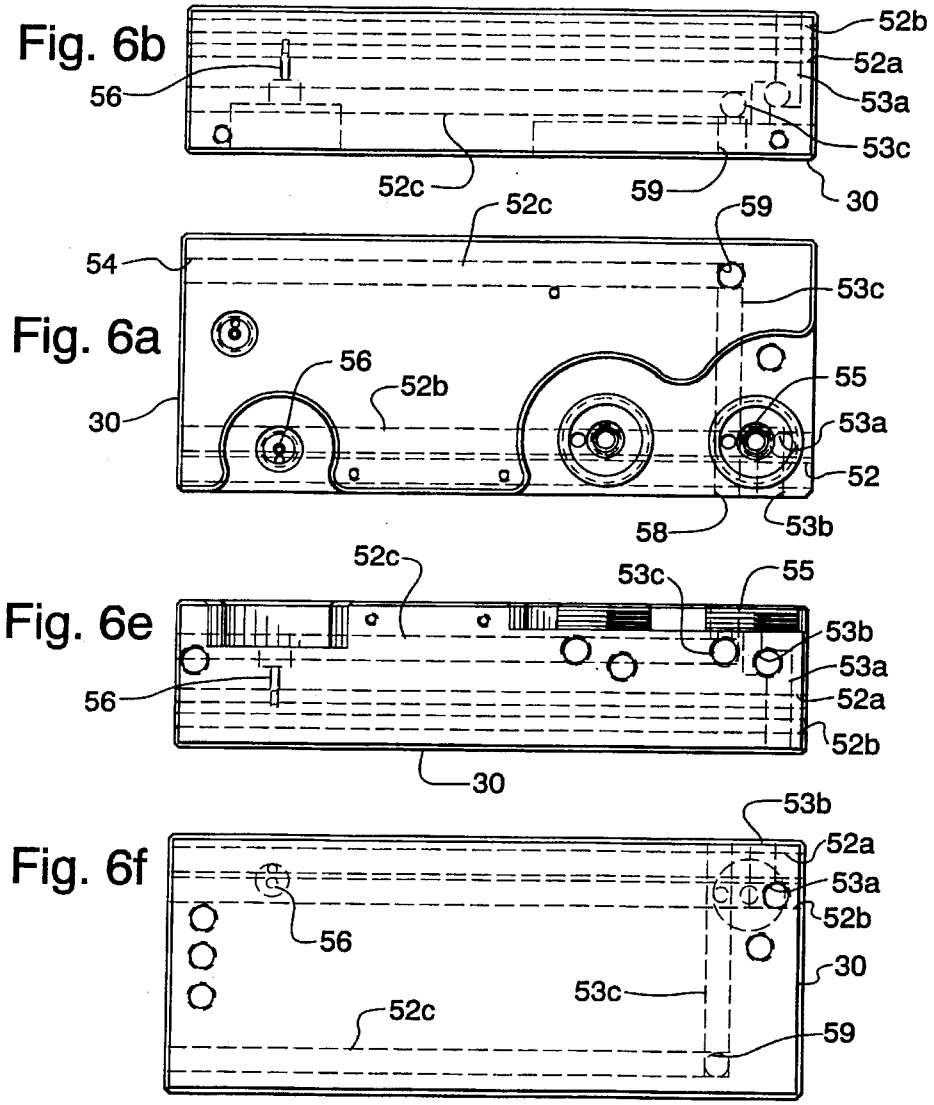
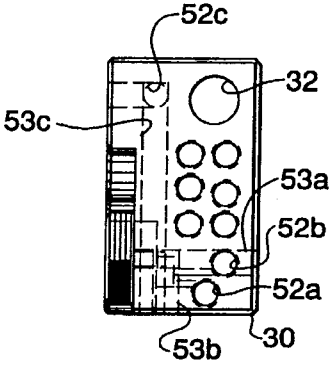
Fig. 6d
Fig. 6
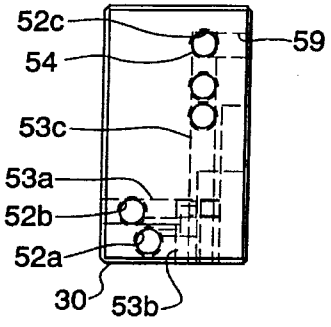
Fig. 6c

PREHEATER BLOCK FOR MULTI OIL FURNACES

BACKGROUND OF THE INVENTION

This invention relates generally to furnaces for the burning of used oil and, more particularly, to a preheater block for use in conjunction with multi oil furnaces to improve the control of the burning of used oil therein.

Multi oil furnaces are similar to standard oil burning furnaces, but have been adapted to handle oil products that have been previously used in a traditional lubricating operation. Such oil products can have significantly varying viscosities and significantly varying burning characteristics, as well. Typically, used oil products are collected into a tank to be supplied to the furnace from a single source. As furnaces are normally operated when the ambient air temperatures are sufficiently cold to warrant the use of the furnace, the supply of used oil to the furnace is normally as cold as the ambient temperature.

The supply of cold used oil to the furnace provides several problems with respect to regulating the flow of the used oil to the furnace and oil regulators have been provided to control the rate of flow. As the temperature of the supply of used oil decreases, the viscosity of the oil lowers. Further complicating the control of the rate of flow is the changing of the natural viscosity of the oil product itself, as the various oil products do not normally become homogeneously mixed in the storage tank, but rather stay segregated in the order in which they were introduced into the tank.

Accordingly, a setting of the oil flow regulator at an appropriate position to provide an acceptable flame, and therefore an acceptably efficient burning of the oil product, in the burner chamber will result in a unacceptable flame in the burner chamber as the temperature of the used oil changes or as the type of used oil product changes. The resultant change could be either an over-firing of the burner chamber, which can result in a destructive deterioration of the furnace and furnace components, or an under-firing of the burner chamber, which can result in an inefficient burning of the oil products and a polluting of the air.

A pre-heating of the used oil before being introduced into the burner chamber has been devised. The known preheater block has utilized a heating element into the flow path of the used oil into the burner chamber. The direct heating of the oil products results in a residue build-up of the heating element, requiring a periodic replacement of the heating element to maintain the effectiveness thereof. Even with the preheating of the used oil, the regulation of the flow of cold used oil into the preheater for introduction into the burner chamber remained dependent on the temperature fluctuations of the used oil supply.

Accordingly, it would be desirable to provide a multi oil preheating mechanism that would improve the operation of the multi oil furnace, particularly by improving the capability of regulating the flow of used oil to the burner chamber.

SUMMARY OF THE INVENTION

It is an object of this invention to provide a preheater block for a multi oil furnace to improve the operation of the furnace in the burning of used oil products.

It is another object of this invention to provide a preheater block incorporating an oil flow regulating mechanism that is not sensitive to temperature fluctuations in the used oil supply.

It is an advantage of this invention that the efficiency of the operation of a multi oil furnace is improved.

It is another advantage of this invention that the pollution of the air environment by the combustion gases is minimized.

It is a feature of this invention that the temperature of the used oil supplied to the burner chamber is uniformly maintained at a predetermined temperature.

It is still another object of this invention to locate the oil flow regulating mechanism on the preheater block to be coupled into the flow path for the used oil after the used oil has attained a predetermined temperature.

It is another feature of this invention that the oil flow regulator is operable on used oil having a uniform temperature.

It is still another advantage of this invention that the temperature fluctuations in the supply of used oil do not have any effect on the regulation of the rate of flow of used oil to the burner chamber.

It is still another object of this invention that the preheater block is formed with a plurality of interconnected passageways therethrough defining a oil flow path that provides a multiple number of passes through the block to allow the conductive heat to be absorbed into the used oil.

It is still another feature of this invention that the passageways are formed by drilling a number of parallel holes into the block and a number of perpendicular holes intersecting a selected pair of said first holes to form a oil flow path having a multiple number of passes through the preheater block.

It is yet another advantage of this invention that an oil shut-off mechanism can be located on the preheater block adjacent the outlet port thereof to the burner chamber to minimize the oil drip after the oil flow is discontinued.

It is yet another object of this invention that the heating element in the preheater block is located in a heating chamber separate from the oil flow path.

It is yet another feature of this invention that the heat supplied from the heating element is conducted throughout the body of the preheater block to be absorbed into the flow of used oil through the preheater block.

It is a further advantage of this invention that the heating element has a longer life.

It is a further object of this invention that the preheater block is formed with a second flow path therethrough for the flow of compressed air to the burner chamber.

It is still a further advantage of this invention that the compressed air is warmed to substantially the same temperature as the used oil passing through the preheater block before being fed to the burner assembly in the furnace burner chamber.

It is a further feature of this invention that the preheater mechanism includes an air shut-off mechanism to stop the flow of compressed air to the burner chamber.

It is still a further feature of this invention that the air shut-off mechanism and the oil shut-off mechanism are operatively connected through a control mechanism such that the oil shut-off mechanism halts the flow of used oil to the burner chamber whenever the flow of compressed air is halted.

It is yet a further object of this invention to provide a preheater block for a multi oil furnace which is durable in construction, inexpensive of manufacture, carefree of maintenance, facile in assemblage, and simple and effective in use.

These and other objects, features, and advantages are accomplished according to the instant invention by providing a preheater block for a multi oil furnace wherein the metallic preheater block is formed with a separate heater chamber housing a heating element to provide conductive heat throughout the preheater block which is provided with a first flow path defining multiple passes through the preheater block to raise the temperature of the flow of used oil therethrough to a predetermined level. An oil flow regulator is coupled to the first flow path to permit a manual regulation of the rate of used oil flow through the preheater block after the used oil has attained the predetermined temperature. A second flow path is defined within the preheater block to allow a flow of compressed air therethrough to reach substantially the same predetermined temperature as the used oil.

BRIEF DESCRIPTION OF THE DRAWINGS

The advantages of this invention will become apparent upon consideration of the following detailed disclosure of the invention, especially when taken in conjunction with the accompanying drawings wherein:

FIG. 6 is a six-view orthographic projection development of the preheater block with dotted lines depicting the passageways defining the flow path of the compressed air through the preheater block with FIG. 6*a* being the top;

FIG. 6*b* being the rear;

FIG. 6*c* being the left end;

FIG. 6*d* being the right end;

FIG. 6*e* being the front; and

FIG. 6*f* being the bottom;

DETAILED DESCRIPTION OF THE PREFERRED EMBODIMENT

Figure 1:
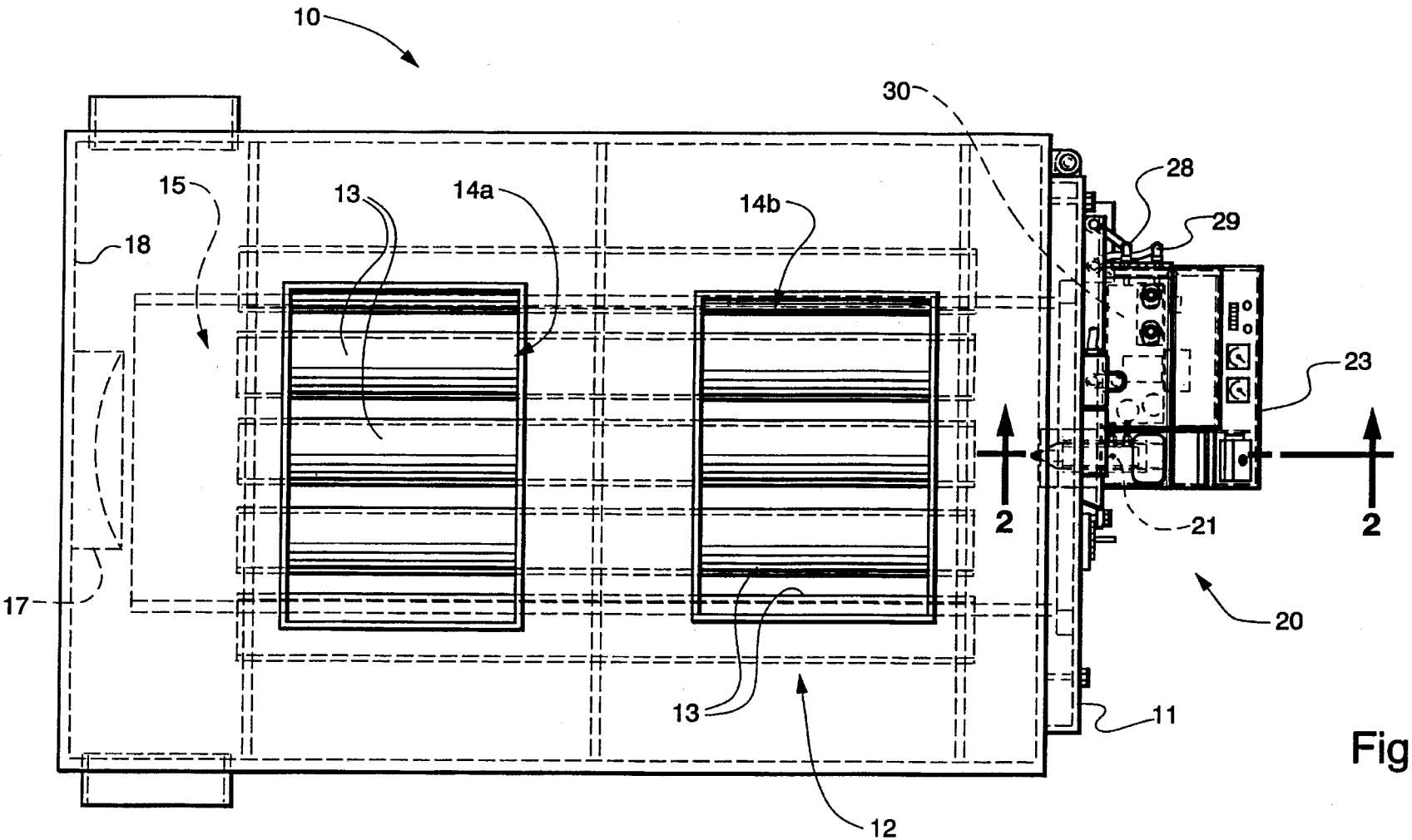
FIG. 1 is a top plan view of a multi oil furnace incorporating the principles of the instant invention.

Referring now to FIG. 1, a top plan view of a multi oil furnace incorporating the principles of the instant invention can best be seen. The furnace 10 includes a shell enveloping a heat exchanger 12 and a central burner chamber 15. A burner assembly 20 is mounted on the front door 11 to fire a flame into the burner chamber 15 toward a target 17 mounted on the back wall 18 of the burner chamber 15. The heat exchanger 12 allows the circulation of clean air to be heated around pipes 13 carrying heated combustion gases before being discharged from the furnace 12. The furnace 12 incorporates a clean air inlet opening 14*a* and a clean air exit opening 14b to provide for the passage of the clean air to be heated within the heat exchanger 12.

Figure 2:
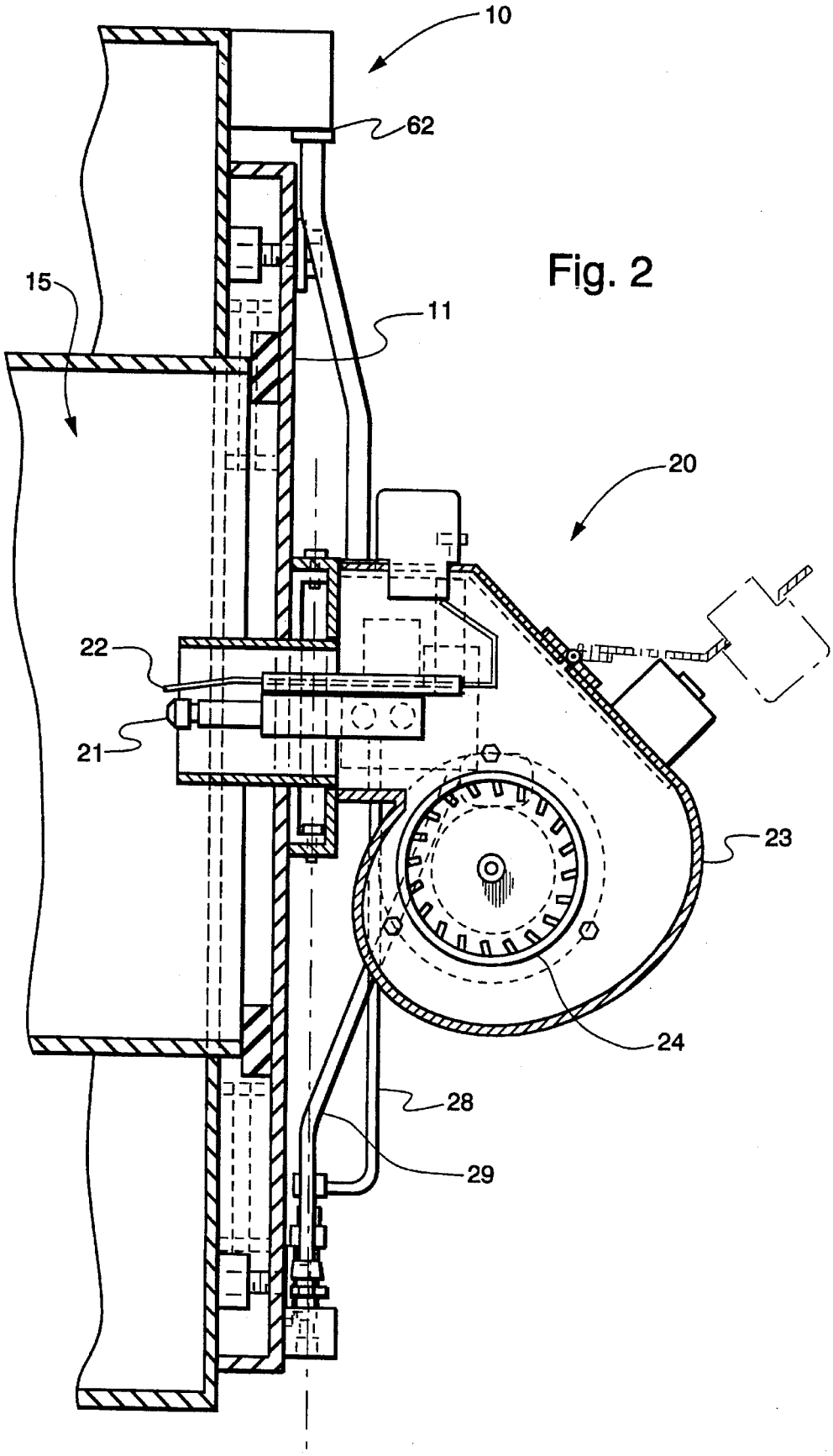
FIG. 2 is an enlarged cross-sectional view of the multi oil furnace taken along lines 2—2 of FIG. 1 to better show the burner assembly.
Figure 3:
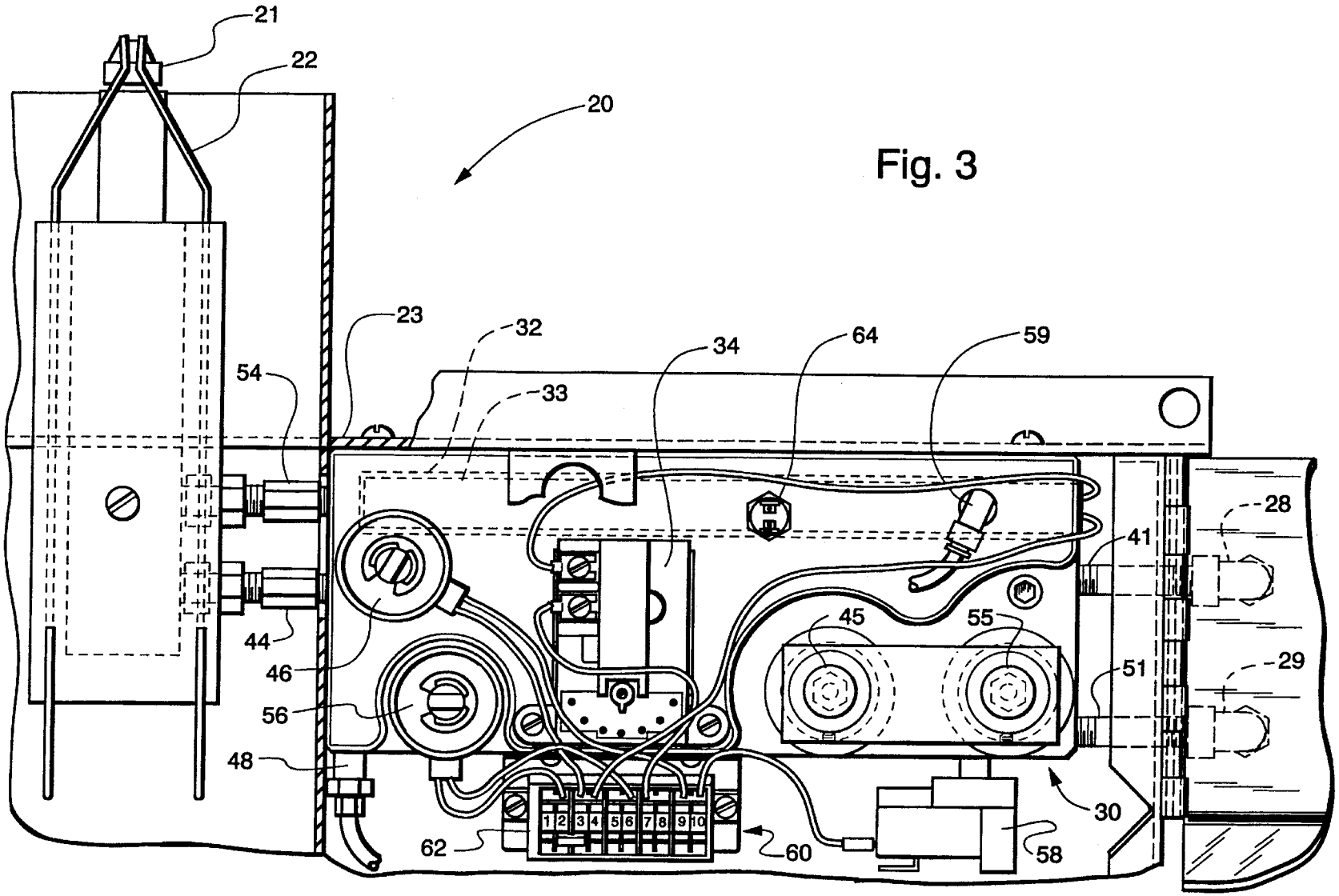
FIG. 3 is an enlarged partial cross-sectional view of the burner assembly to depict a top view of the preheater block.

Referring now to the views of FIGS. 2 and 3, the details of the burner assembly 20 and the preheater block 30 can best be seen. The burner assembly 20 includes a burner nozzle 21 and an igniter 22 to create a flame from the used oil supplied thereto as defined in greater detail below. The burner assembly 20 also includes a housing 23 in which is mounted a fan 24 to supply large quantities of combustion air over the nozzle 21 and igniter 22 to support the creation of a flame in the burner chamber 15. The preheater block 30 is also mounted on the burner housing 23 adjacent the burner nozzle 21 and the igniter 22 to mount various controls for the flow of used oil and compressed air to the burner nozzle 21, as will also be described in greater detail below.

Figures 4, 4A, 4B, 4C, 4D, 4E, 4F:
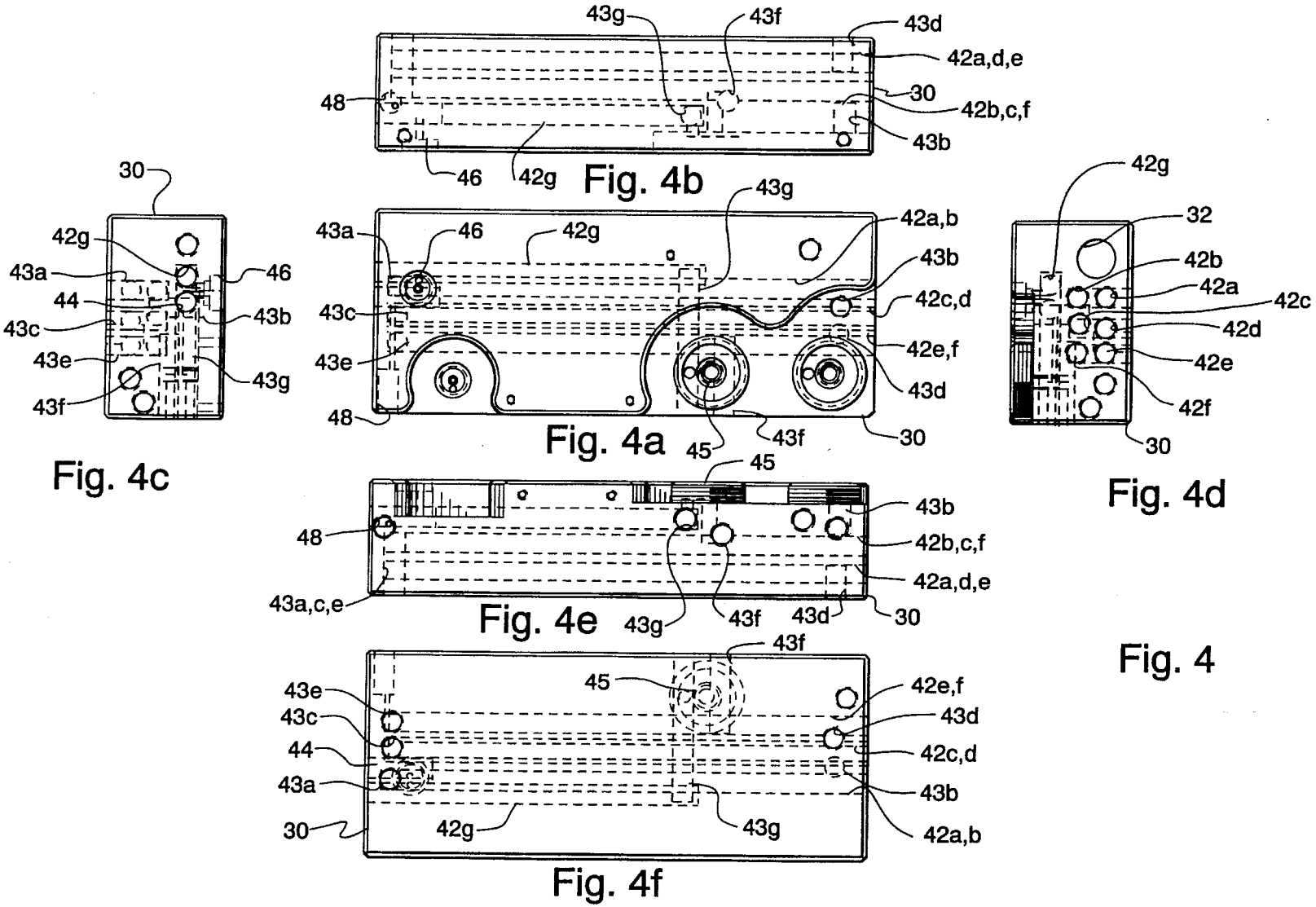
FIG. 4 is a six-view orthographic projection development of the preheater block with dotted lines depicting the passageways defining the flow path of the used oil through the preheater block with FIG. 4*a* being the top.
FIG. 4*b* being the rear.
FIG. 4*c* being the left end.
FIG. 4*d* being the right end.
FIG. 4*e* being the front.
FIG. 4*f* being the bottom.
Figure 5:
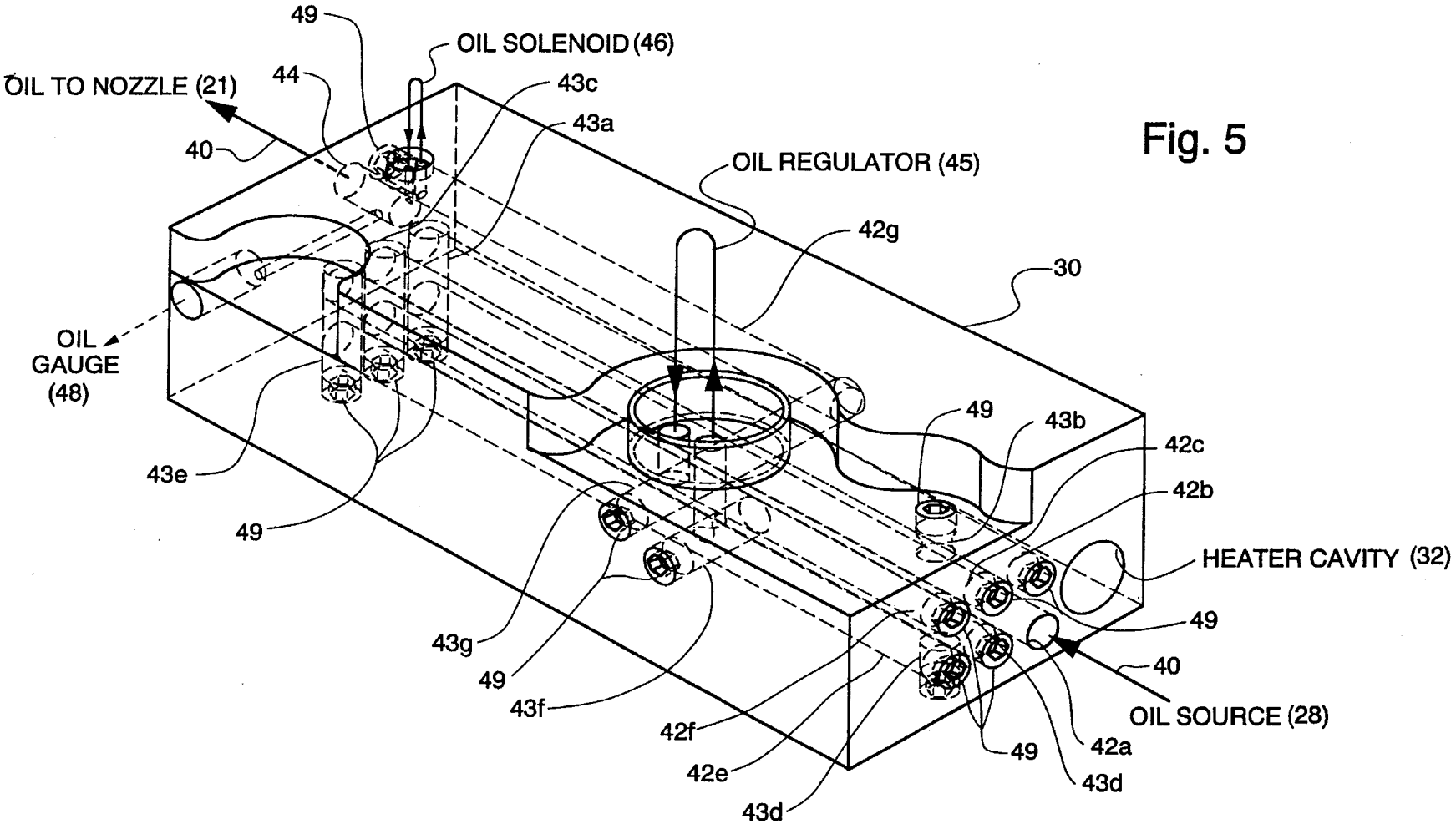
FIG. 5 is a perspective view of the preheater block depicting only the oil flow path through the preheater block, the various passageways and associated openings being shown in dotted lines.

Referring now to FIGS. 3–5, the operation of the preheater block 30 to supply preheated used oil to the burner nozzle 21 can best be seen. The preheater block 30 defines two separate flow paths for used oil and compressed air, respectively. The operation of the preheater block 30 to supply preheated compressed air will be described below in conjunction with FIGS. 3, 6 and 7. The preheater block 30 is formed with a heater chamber 32 in which is housed a heating element 33, electrically coupled to a preheater thermostat 34 and a power supply 62. The heating element 33 is removably mounted within the heater chamber 32 and provides a source of heat when electrical current is passed through the heating element 33. The preheater block 30 is formed of metallic material, such as aluminum, and is, therefore, conductive of the heat generated by the heating element 33.

The flow path 40 for used oil through the preheater block 30 is defined by a series of first parallel passageways 42*a*–*f* drilled into the preheater block 30, beginning at an oil inlet port 41 which is connected to an external supply of used oil (not shown) via a connecting line 28. Several second passageways 43*a*–*g* are drilled into the preheater block 30 perpendicularly to the first passageways 42*a*–*g* to intersect selected pairs of the first passageways 42*a*–*g* in a manner to provide an interconnected passageway to a used oil outlet port 44 leading to the burner nozzle 21. Except where the drilled entrance of the passageway 42*a*–*g*, 43*a*–*g* is used to mount a switch, gauge or port, the drilled entrance is plugged by a threaded plug 49 sealing the passageway 42*a*–*g*, 43*a*–*g* from the exterior of the preheater block 30.

The first passageway 42*a* extends longitudinally through the preheater block 30 from the used oil inlet port 41. The perpendicular second passageway 43*a* is drilled vertically from the bottom of the preheater block 30 and intersects the passageway 42*a* and the parallel longitudinal passageway 42*b* positioned immediately above the passageway 42*a*. Another perpendicular passageway 43*b* is drilled into the preheater block near the right side thereof to intersect the two laterally spaced passageways 42*b* and *c*. The second of the left side second passageways 43*c* is drilled from the bottom of the block 30 to intersect the two vertically aligned first passageways 42*c* and *d*. The other right side second passageway 43*d* is also drilled into the bottom of the block 30 to intersect the two laterally spaced first passageways 42*d* and *e*. The last of the left side second passageways 43*e* is also drilled into the bottom of the block 30 to intersect the two vertically aligned first passageways 43*e* and *f*. A transverse second passageway 43*f* is drilled into the front of the preheater block 30 to intersect the first passageway 42*f* and allow the used oil to flow through a flow regulator 45. Another transverse second passageway 43*g* receives the used oil discharged from the flow regulator 45 and carries the flow of used oil above the parallel first passageways 42*a–f* to the last of the first passageways 42*g*, which is drilled into the block 30 from the left end, to deliver the used oil to the outlet port 44. Before reaching the outlet port 44, the flow of used oil must pass through a solenoid shut-off valve 46 tapped into the passageway 42*g*. The solenoid valve 46 is normally spring-loaded into a closed position to prevent the flow of oil therethrough, but when energized allows the used oil to flow to the outlet port 44 and on to the burner nozzle 21. An oil pressure gauge 48 is tapped into the outlet passageway 42*g* between the solenoid shut-off valve 46 and the outlet port 44.

Accordingly, used oil moving along the oil flow path 40 makes approximately 5 and ½ passes through the preheater block 30 to absorb conductive heat supplied by the heating element 33 before reaching the flow regulator 45. By the time the used oil reaches the flow regulator 45, the used oil has attained a predetermined desired temperature. No matter what type of used oil is fed into the preheater block 30, the used oil reaches that predetermined temperature to provide a constant factor in regulating the firing of the burner chamber 15. The precisely located passageways 42*a–g* and 43*a–g* defines the used oil flow path 40 that makes multiple passes through the preheater block to raise the temperature of the used oil to a predetermined temperature without coming into direct contact with the heating element 33. The positioning of the solenoid shut-off valve 46 immediately adjacent the outlet port 44 minimizes the amount of used oil that can drip out of the burner nozzle 21 whenever the used oil flow is interrupted.

Figure 7:
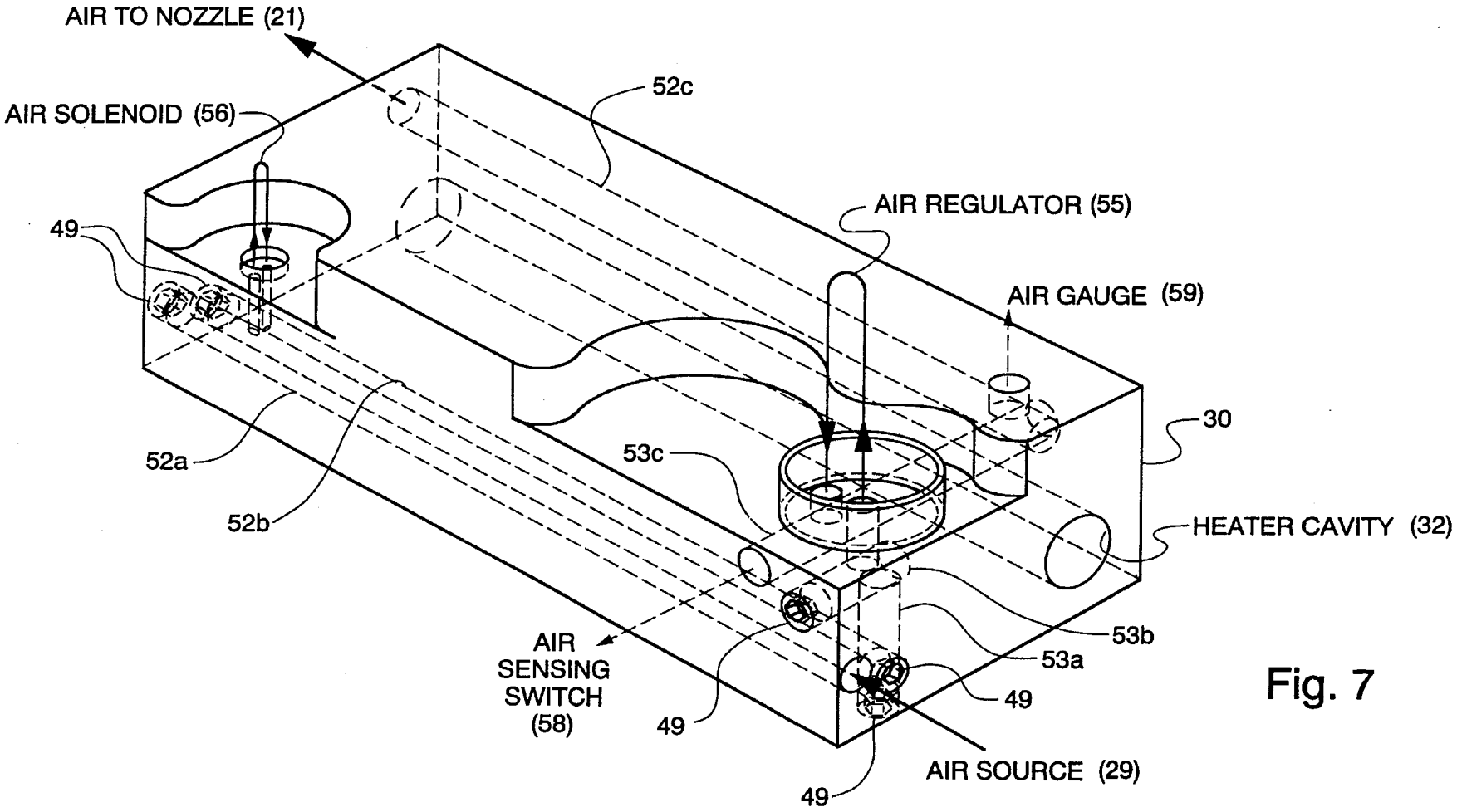
FIG. 7 is a perspective view of the preheater block depicting only the compressed air flow path through the preheater block, the various passageways and associated openings being shown in dotted lines.

Referring now to FIGS. 3, 6 and 7, the compressed air flow path 50 through the preheater block 30 can best be seen. The flow path 50 for compressed air through the preheater block 30 is defined by a series of first longitudinally extending parallel passageways 52*a–c* drilled into the preheater block 30, beginning at an air inlet port 51 which is connected to an external supply of compressed air (not shown) via a connecting line 29. A solenoid shut-off valve 56 to coupled to both the inlet passageway 52*a* and the return passageway 52*b* to provide an interconnecting flow path therebetween. A perpendicular second passageway 53*a* is drilled into the bottom of the preheater block 30 to intersect the return first passageway 52*b*. An air flow regulator 55 is tapped into the flow path 50 via the perpendicular passageway 53*a* and the transverse second passageway 53*b* to control the flow rate of air through the air flow path 50. The discharge of air from the flow regulator 55 is received in another transverse second passageway 53*c* carrying the flow of air above the first parallel used oil passageways 42, the first air passageways 52 and the heater chamber 32 to intersect the outlet first passageway 52*c* leading to the outlet port 54 and the burner nozzle 21. An air sensing switch 58 and an air pressure gauge 59 can be operatively coupled to the transverse second passageway 53*c*.

Accordingly, compressed air moving along the air flow path 50 makes approximately three passes through the preheater block 30 to absorb conductive heat supplied by the heating element 33 before reaching the outlet port 54. This has been found to be sufficient time for the compressed air to attain substantially the same predetermined temperature as the used oil flowing through the oil flow path 40. As a result, the compressed air and the used oil will be at approximately the same temperature when they are combined in the burner nozzle 21 to atomize the used oil for efficient burning thereof. The positioning of the solenoid shut-off valve 56 is primarily a matter of convenience as an interruption of the air flow anywhere along the air flow path 50 will effectively halt the supply of compressed air to the burner nozzle 21. As with the oil flow path 40, each of the air passageways 52*a–c*, 53*a–c* are sealed with a plug 49, except where used for a switch, gauge or port.

Figure 8:
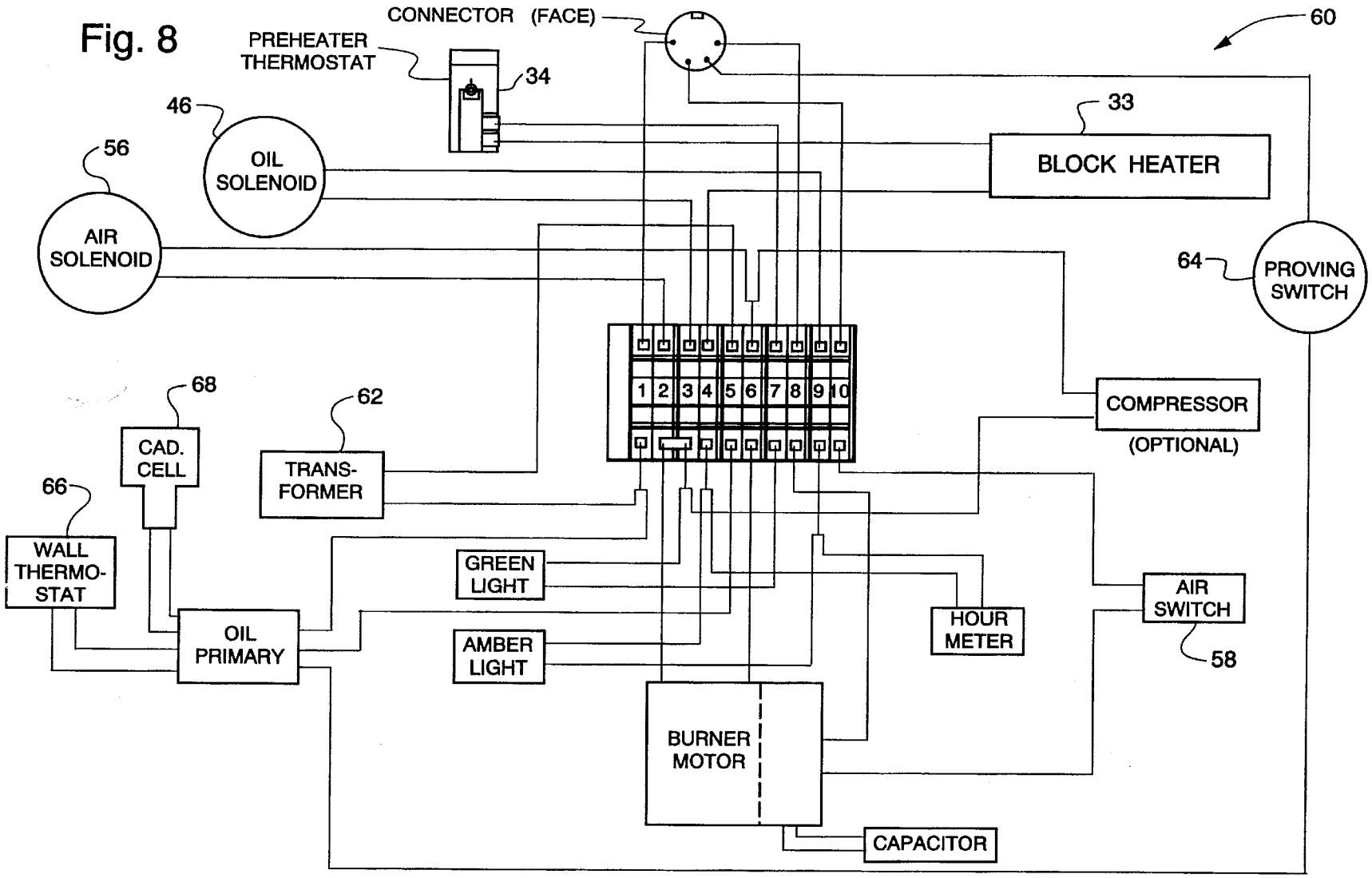
FIG. 8 is a schematic wiring diagram of the electrical circuit for the multi oil furnace.

Referring now to the schematic electrical wiring diagram of FIG. 8, several of the safeguards incorporated into the operation of the used oil furnace 10 can be seen. The control mechanism 60 operatively interconnects several switches and sensors to control the operation of the furnace 10. For example, if the flow of compressed air is interrupted through the air flow path 50, as sensed by the air sensing switch or the deenergizing of the air solenoid shut-off valve 56, the oil solenoid shut-off valve 46 is immediately de-energized to stop the flow of used oil through the oil flow path 40 to the burner nozzle 21. A proving switch 64 is mounted on the preheater block 30 and will not allow the furnace 10 to operate unless the preheater block 30 has been warmed to the predetermined temperature by the heating element 33. A CAD cell 68 is operable to detect the existence of a flame within the burner chamber 15. The control mechanism 60 will automatically de-energize the air and oil solenoid shut-off valves 46, 56 if a flame in the burner chamber 15 is not detected immediately after heat is called for by the wall thermostat 66.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly as well as in the specific form shown.

Having thus described the invention, what is claimed is:

1. In a multi oil furnace having a burner chamber in which is housed a burner assembly for igniting and burning used oil supplied thereto; means for supplying a flow of used oil to said burner assembly; oil regulator means for controlling the flow of used oil to said burner assembly; a preheater block formed of heat conductive material and being co-operable with said means for supplying used oil to preheat said used oil before being fed to said burner assembly, an improved preheater block comprising:

a heater chamber for housing a heating element;

a plurality of interconnected first passageways separate from said heater chamber to define a first serpentine flow path for the flow of used oil therethrough, the flow of used oil through said interconnected first passageways allowing said used oil to absorb conductive heat from said heating element; and a plurality of interconnected second passageways separate from said heater chamber and said first passageways and defining a second serpentine flow path through said preheater block for the flow of compressed air therethrough to allow said compressed air to absorb conductive heat from said heating element and reach substantially the same temperature as said heated used oil.

2. The multi oil furnace of claim 1 wherein said interconnected first passageways define said first flow path from an inlet port through which unheated used oil is introduced into said preheater block to an outlet port through which heated used oil is delivered to said burner assembly, said oil regulator means being operable to control the flow of said used oil after being heated in said preheater block.

3. The multi oil furnace of claim 2 wherein said oil regulator means includes an oil flow regulator supported on said preheater block, said oil flow regulator being operatively coupled to said first passageways to control the flow of said used oil through said first flow path upstream from said outlet port.

4. The multi oil furnace of claim 3 wherein said oil regulator means further includes an oil shut-off mechanism supported on said preheater block adjacent said outlet port to stop the flow of used oil through said first flow path.

5. The multi oil furnace of claim 4 wherein said oil shut-off mechanism includes a solenoid valve.

6. The multi oil furnace of claim 4 wherein said preheater block is formed of metallic material, said first passageways comprising a plurality of first parallel holes drilled into said block and a plurality of second holes extending generally perpendicularly to said first holes, each of said second holes intersecting a selected pair of said first holes to form said first flow path which passes back and forth through said preheater block.

7. The multi oil furnace of claim 4 further comprising air regulator means for controlling the flow of said compressed air to said burner assembly, said air regulator means being positioned between said second passageways and an air outlet port such that said compressed air is substantially at said predetermined temperature as said heated used oil before reaching said air regulator means.

8. The multi oil furnace of claim 7 wherein said air regulator means further includes an air shut-off mechanism supported on said preheater block to stop the flow of compressed air through said second flow path.

9. The multi oil furnace of claim 8 wherein said oil shut-off mechanism is operatively coupled to a control mechanism to effect an actuation of said oil shut-off mechanism to stop the flow of oil through said first flow path whenever the flow of compressed air through said second flow path is interrupted.

10. A preheater block for a multi oil furnace having a burner chamber in which is housed a burner assembly for igniting and burning used oil supplied thereto, comprising:

a body formed of heat conductive material;

a heating element cooperatively associated with said body to provide a source of heat thereto;

first interconnected passageways through said body for the flow of used oil therethrough to allow said used oil to absorb conductive heat from said heating element to raise the temperature of said used oil to a predetermined temperature, said first passageways defining a first serpentine flow path from an oil inlet port through which unheated used oil is introduced into said preheater block to an oil outlet port through which heated used oil is delivered to said burner assembly; and oil regulator means operatively coupled to said first passageways for controlling the rate of flow of said used oil through said first flow path, said oil regulator means being positioned between said oil outlet port and said first passageways such that used oil is substantially at said predetermined temperature before reaching said oil regulator means.

11. The preheater block of claim 10 further comprising an oil shut-off mechanism supported on said preheater block adjacent said outlet port and being operable to stop the flow of used oil through said first flow path.

12. The preheater block of claim 11 further comprising a heater chamber for housing said heating element, said heater chamber being separate from said first passageways so that said used oil does not contact said heating element directly.

13. The preheater block of claim 12 further comprising second interconnected passageways through said body separate from both said first passageways and said heater chamber and defining a second flow path through said preheater block for the flow of compressed air therethrough to allow said compressed air to absorb conductive heat from said heating element and reach substantially the same temperature as said heated used oil before being supplied to said burner assembly, said compressed air being used in said burner assembly to atomize said heated used oil.

14. The preheater block of claim 13 wherein said preheater block is formed of metallic material, said first passageways comprising a plurality of first parallel holes drilled into said block and a plurality of second holes extending generally perpendicularly to said first holes, each of said second holes intersecting a selected pair of said first holes to form said first flow path which passes back and forth through said preheater block.

15. The preheater block of claim 14 further comprising an air shut-off mechanism supported on said preheater block to stop the flow of compressed air through said second flow path, said air shut-off mechanism and said oil shut-off mechanism being operatively coupled to a control mechanism to effect an actuation of said oil shut-off mechanism to stop the flow of oil through said first flow path whenever the flow of compressed air through said second flow path is interrupted.

16. A multi oil furnace comprising:

a burner chamber in which is housed a burner assembly for igniting and burning used oil supplied thereto;

means for supplying a flow of used oil to said burner assembly;

a preheater block formed of heat conductive metallic material and being co-operable with said means for supplying used oil to preheat said used oil before being fed to said burner assembly;

a heater chamber formed in said preheater block for housing a heating element;

a plurality of interconnected first passageways formed within said preheater block separate from said heater chamber for the flow of used oil therethrough, the flow of used oil through said interconnected first passageways allows said used oil to absorb conductive heat from said heating element to raise the temperature of said used oil to a predetermined temperature, said first passageways defining a first serpentine flow path from an oil inlet port through which unheated used oil is introduced from said means for supplying a flow of used oil into said preheater block to an oil outlet port through which heated used oil is delivered to said burner assembly;

oil regulator means operatively coupled to said first passageways for controlling the rate of flow of said used oil through said first flow path, said oil regulator means being positioned between said oil outlet port and said first passageways such that used oil is substantially at said predetermined temperature before reaching said oil regulator means;

a plurality of interconnected second passageways formed within said preheater block separate from said heater chamber and said first passageways and defining a second serpentine flow path through said preheater block for the flow of compressed air therethrough to allow said compressed air to absorb conductive heat from said heating element and reach substantially the same temperature as said heated used oil; and air regulator means being positioned between said second passageways and an air outlet port such that said compressed air is substantially at said predetermined temperature as said heated used oil before reaching said air regulator means.

17. The multi oil furnace of claim 16 further comprising:

an oil shut-off mechanism supported on said preheater block adjacent said outlet port and being operable to stop the flow of used oil through said first flow path;

an air shut-off mechanism supported on said preheater block to stop the flow of compressed air through said second flow path;

said air shut-off mechanism and said oil shut-off mechanism being operatively coupled to a control mechanism to effect an actuation of said oil shut-off mechanism to stop the flow of oil through said first flow path whenever the flow of compressed air through said second flow path is interrupted.

18. The multi oil furnace of claim 17 wherein said first passageways comprise a plurality of first parallel holes drilled into said block and a plurality of second holes extending generally perpendicularly to said first holes, each of said second holes intersecting a selected pair of said first holes to form said first flow path which passes back and forth through said preheater block.

19. The multi oil furnace of claim 18 wherein both said oil shut-off mechanism and said air shut-off mechanism include an electrically actuated solenoid valve.

* * * * *